US005652023A

United States Patent [19]

Bergervoet et al.

[11] Patent Number: 5,652,023

[45] Date of Patent: Jul. 29, 1997

[54] FIXATION PROCESS FOR HEAT-FIXABLE PRESERVATIVE TREATED WOOD

[75] Inventors: Anthony J. Bergervoet, Bli Bli, Australia; James L. Marcinko, Kannapolis; Paul Joseph Walcheski, Mount Ulla, both of N.C.

[73] Assignee: Chemical Specialties, Inc., Charlotte, N.C.

[21] Appl. No.: 609,087

[22] Filed: Feb. 29, 1996

[51] Int. Cl.[6] ..... B05D 3/00

[52] U.S. Cl. ..... 427/297; 427/298; 427/335; 427/345; 427/381

[58] Field of Search ..... 427/297, 298, 427/335, 381, 345

[56] References Cited

U.S. PATENT DOCUMENTS

| | | | |
|---|---|---|---|
| 4,303,705 | 12/1981 | Kelso, Jr. | 427/351 |
| 4,364,976 | 12/1982 | Prokofievna et al. | 427/297 |
| 4,927,672 | 5/1990 | Drinkard, Jr. | 427/336 |
| 4,942,064 | 7/1990 | Brayman et al. | 427/297 |
| 5,080,935 | 1/1992 | Kelso et al. | 427/297 |
| 5,395,656 | 3/1995 | Liang | 427/297 |

OTHER PUBLICATIONS

Zahora et al. (1993) Am Wood–Preservers' Asso. pp. 147–166 (no mo.).

Anderson, D.G. (1990) Am Wood–Preservers' Asso. pp. 129–151 (no mo.).

*Primary Examiner*—Janyce Bell

*Attorney, Agent, or Firm*—Klauber & Jackson

[57] ABSTRACT

An improved process for the fixation of preservatives in wood is disclosed which initiates the fixation process in the fixation vessel by the application of sufficient pressure to substantially obviate a thermal expansion effect of the treated wood; contacts the treated wood in the fixation vessel with an aqueous liquid heating medium preheated to a temperature of about 130° to no more than about 200° F. for a period of thirty minutes to about two hours; removes the aqueous liquid heating medium from the fixation vessel; applies a vacuum in the range of 10–30" Hg for a duration of up to about 30 minutes; and rinses the treated and fixed wood in said fixation vessel with heated clean water, heated to a temperature of about 200° F.

28 Claims, 3 Drawing Sheets

FIXATION PROCESS FOR HEAT-FIXABLE PRESERVATIVE TREATED WOOD

FIELD OF THE INVENTION

The present invention is in the field of methods for treating wood with preservatives and methods for fixing those preservatives in the wood, as well as of methods which improve the wood preserving and fixing technology by increasing the consumer and environmental acceptability of the treated wood final product.

BACKGROUND OF THE INVENTION

Preservatives, especially CCA (chromated copper arsenate), CCB (chromated copper borate), ACA (ammoniacal or amine copper arsenate), and the like, have found extensive usage in wood, fox the purpose of extending the useful life of the wood by their incorporation into same. Due to the highly toxic effects of these preservatives, even at very low levels, their use in the treatment of large quantities of wood, poses environmental concerns for the manufacturers. Numerous modifications of the general process of impregnating the wood with these preservatives have been developed in order to produce an economically feasible product while still meeting the strict environmental standards imposed upon the industry as a whole.

The principal problem in the overall process is the need to fully fix the preservative within the wood during the treatment process in order to minimize or eliminate the subsequent contamination of the area around the wood caused by the runoff of excess, or non-fixed, preservative. Unless preservative is fixed within the wood, rain water will wash or leach preservative components out of the treated lumber and onto or into the soil, where they may be carried into groundwater or waterways, thus contaminating the surroundings as these metals accumulate. Present EPA regulations define any soil or water that tests above 5.0 ppm for either arsenic or chromium as "hazardous waste", and designates the site where they are located as "contaminated". When such conditions arise, the treaters and/or their customers are required to decontaminate the site, and dispose of the "hazardous waste" at approved landfills.

The so-called "Drinkard Process" developed by William F. Drinkard, Jr. and disclosed in U.S. Pat. No. 4,927,672, used a hot-water fixation step to accelerating fixing of fixable wood preservatives in freshly impregnated wood. The process involves contacting preservative-impregnated wood with an aqueous heated liquid medium preheated to at least 100° F., raising the temperature of the wood from ambient to from 100° F. to 240° F., and maintaining both liquid contact and raised temperature of the wood for a period of time from 20 minutes up to 2 hours, whereby complete fixation occurs in less than 48 hours. It has recently been discovered that this process, while an improvement over other existing processes using steam or heated air to fix the preservatives, results in a high amount of sludge formation in the fixation medium and/or a product that is not acceptable to the consumer due to its disfigurement by the sludge chemicals.

Another process available to the wood preservative industry, but not generally used because of its practical limitations, is disclosed in U.S. Pat. No. 4,303,705, which utilizes heating under pressure with the treating solution in order to effect fixation of the preservatives. This process, however, requires the wood to be retained within the treating vessel for the additional amount of time needed for fixation, resulting in a prolonged cycle time, and there is difficulty in maintaining pressure during removal of the treating solution and then filling with the heating medium. The objective of this process is to produce a treated wood of lower weight than the prior art methods, rather than to improve fixation. It is probable that sludging difficulties similar to those discovered with the so-called "Drinkard process" would also occur with the process disclosed in U.S. Pat. No. 4,303,705.

OBJECTS OF THE INVENTION

An object of the present invention is to provide an improved method of treating wood with preservatives and fixing the preservatives so as to obviate environmental concerns while still providing an economical product which meets consumer standards for product appearance, and regulatory standards for leachant contamination.

It is thus an object of the present invention to provide an improved method of treating wood with preservatives and fixing the preservatives so as to obviate environmental concerns regarding the manufacturing process and the finished product.

It is a further object of this invention to provide an economical product which can be produced without the need for long fixation times.

It is a still further object of the present invention to obviate the problems of sludge formation in the fixation medium and its subsequent deposition on the finished lumber product by reducing the transfer of sludge-forming ingredients from the wood to the fixation process medium while the wood is contacted by the fixation medium.

It is still another object of the present invention to obviate the problems of sludge formation in the fixation medium and its subsequent deposition on the finished lumber product by removal of dissolved contaminants from the fixation medium before they have an opportunity to form sludge.

It is yet a still further object of the present invention to obviate the problems of sludge formation in the fixation medium and its subsequent deposition on the finished lumber product by preventing or slowing the sludge formation mechanism.

It is also an object of the present invention to obviate the problems of sludge formation in the fixation medium and its subsequent deposition on the finished lumber product by removing sludge solids from the fixation medium once they have formed.

It is yet a still further object of the present invention to provide a preserved lumber product which meets consumer standards for product appearance, and regulatory standards for leachant contamination or for degree of fixation in the wood.

SUMMARY OF THE INVENTION

Figure 1:
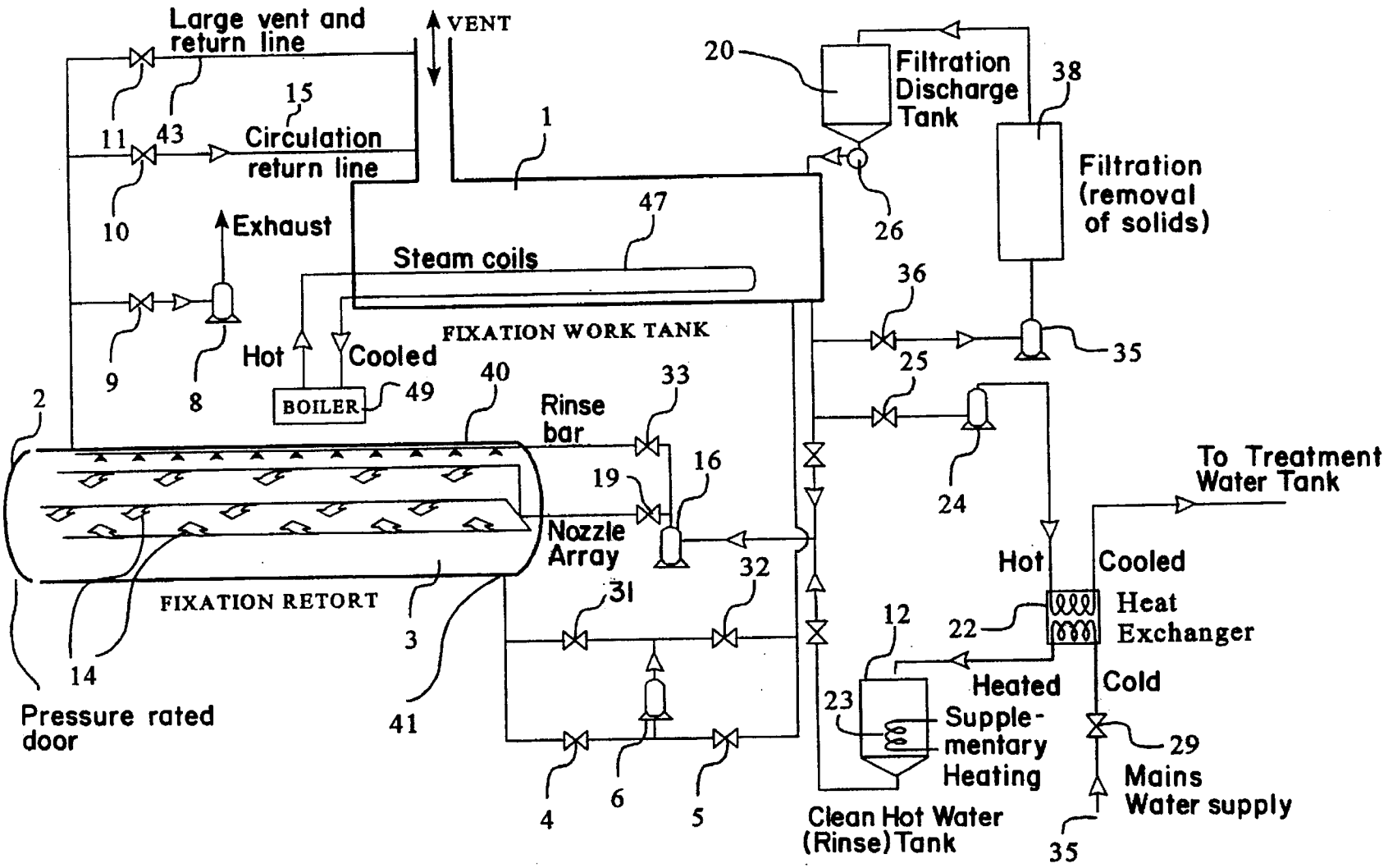
FIG. 1 is a schematic diagram showing the various steps of the process of the present invention, particularly those for controlling the contamination of aqueous liquid heating medium by wood extractives and unfixed preservative known to form sludge from said wood, and by said sludge.

In accordance with the present invention there is provided an improved process for the fixation of heat-fixable preservatives in wood which comprises: (a) placing wood treated with said heat-fixable preservative in a fixation vessel having suitable dimensions; (b) filling said fixation vessel with an aqueous liquid heating medium preheated to a temperature of at least about 130° F. and no greater than about 200° F., preferably at least about 150° F. and no greater than about 180° F.; (c) controlling the contamination of said aqueous liquid heating medium by wood extractives and unfixed preservative known to form sludge from said wood, as well as by said sludge, on an intermittent and/or continuing basis at one or more points in the overall process; (d) maintaining contact of said aqueous liquid heating medium for a period of from about thirty minutes to about two hours to effect fixation of said preservative; (e) removing said aqueous liquid heating medium from said fixation vessel; (f) applying a vacuum in the range of from about 10" to about 30" Hg, preferably from about 15" to about 20" Hg for a duration of up to about 30 minutes, preferably from about 10 minutes to about 30 minutes; (g) rinsing the thus treated and fixed wood in said fixation vessel with heated clean water, heated to a temperature no greater than about 200° F., and preferably nor greater than about 180° F.; and (h) releasing said vacuum, removing said rinse water from said fixation vessel, and removing said wood from said fixation vessel.

DETAILED DESCRIPTION OF THE INVENTION

The present invention relates to a process for treating wood with heat-fixable preservative materials and fixing said preservative materials in the wood. More particularly, this invention relates to a process for treating wood with heat-fixable preservatives, which comprises:

(a) placing the untreated wood in a treatment vessel adapted for pressure;

(b) applying a vacuum of a predetermined level and duration to said wood within said treatment vessel;

(c) introducing the heat-fixable preservative into said treatment vessel in an aqueous treatment medium; (d) raising said pressure within said treatment vessel and impregnating said wood with said heat-fixable preservative until a desired gross absorption is achieved;

(e) releasing said pressure and removing said heat-fixable preservative from said treatment vessel;

(f) applying a vacuum of predetermined level and duration to remove excess preservative, optionally until a desired net absorption of said heat-fixable preservative is achieved;

(g) releasing said vacuum, recovering said removed excess preservative if required, and removing said treated wood from said treatment vessel;

(h) placing said treated wood in a fixation vessel of suitable dimensions;

(i) filling said fixation vessel with an aqueous liquid heating medium preheated to a temperature of at least about 130° F. and no greater than about 200° F., preferably at least about 150° F. and no greater than about 180° F.;

(j) controlling contamination of said aqueous liquid heating medium by wood extractives and unfixed preservative known to form sludge from said wood, as well as by said sludge, on an intermittent and/or continuing basis at one or more points in the overall process;

(k) maintaining contact of said aqueous liquid heating medium for a period of thirty minutes to about two hours to effect fixation of said preservative;

(l) removing of said aqueous liquid heating medium from said fixation vessel;

(m) applying a vacuum in the range of from about 10" to about 30" Hg, preferably from about 15" to about 20" Hg for a duration of up to about 30 minutes, preferably from about 10 minutes to about 30 minutes;

(n) rinsing the treated and fixed wood in said fixation vessel with heated clean water, heated to a temperature no greater than about 200° F., and preferably no greater than about 180° F.; and (o) releasing said vacuum, removing said rinse water from said vessel, and removing said wood from said vessel.

The term "fixation" is used herein to describe the insolubilization of CCA, CCB and ACA wood preservatives through a series of their chemical reactions with the lignin and cellulosic components of the wood to which they are added. The functional result of these fixation reactions is to change the soluble chemicals in treating solutions to insoluble reaction products within the wood. The resulting lumber is stable to leaching and resistant to biological deterioration. The final wood product is deemed "fixed" at the time during the progression of these reactions when it complies with standard tests for assessing the degree of fixation for health and safety or environmental acceptability. As used herein, the expression "fixation performance" means any or all of product appearance, environmental performance, and health and safety performance.

It must be emphasized that the term "wood" is used in a generic or general sense herein, and is intended to cover all species of wood that may be converted to lumber which is then treated in accordance with the methods described herein. The species of wood which is used, however, will largely depend upon the region of the United States or a foreign country in which the saw mills and wood treatment plants are located. For example, the particular treatment and fixation regimes illustrated herein utilize conditions which are usually most suitable for Southern Yellow Pine, since the plants involved are located in the Southeastern United States. In the Western states, on the other hand, other species of wood would be predominant, such as Douglas Fir or Ponderosa Pine, and where these were used to make treated wood, conditions would van, somewhat. For example, the aqueous liquid heating medium which is used to carry out the fixation step is preheated to a temperature of at least about 130° F. and no greater than about 200° F., preferably at least about 150° F. and no greater than about 180° F. In practice, one would use as high a temperature as possible without inducing significant resin bleed in the wood, which would depend in turn on the species of wood being subjected to the fixation procedure. Fir species might be expected to withstand higher temperatures, i.e., not exhibit significant resin bleed, than pine species, especially Southern Yellow Pine, in this regard. Lower temperatures will usually protract the process and thereby increase operating costs without producing any attendant benefit. Thus, the higher temperatures are preferred.

As used herein, the expression "aqueous liquid heating medium" is intended to mean water or any aqueous solution or suspension which will not, of itself, leave a residue on or in the treated wood which is subject to leaching so as to cause environmental contamination. Such a medium would include, e.g., an aqueous ethylene glycol solution. Chemical agents well known in the art may be added which have as their objective the imparting of some additional characteristic to the wood, e.g., pigments and dyes, fungicides, water repellants, flame retardants, and heat fixing resins.

The present invention overcomes the limitations of the prior art by utilizing in the practice of this invention modifications to the prior art methods which substantially obviate the problems of sludge formation and its concomitant deposition upon the finished lumber product, while still meeting the standards for "fixation" of the preservatives within the finished lumber, i.e., complying with standard tests For assessing the degree of fixation for health and safety or environmental acceptability. This is referred to herein as "fixation performance".

The overall process of the present invention for treating wood with heat-fixable preservatives involves placing the wood in a pressure vessel, applying an initial vacuum to the wood, introducing the aqueous heat-fixable preservative into the vessel and raising the pressure within the vessel and impregnating the wood with the heat-fixable preservative until a desired gross absorption is achieved. After applying a final vacuum to recover preservative solution from the wood and removing the wood from the pressure vessel, the preservative-treated wood is placed in a fixation vessel of suitable dimensions and the fixation vessel is filled with an aqueous liquid heating medium preheated to a temperature of at least about 130° F. and no greater than about 200° F., preferably at least about 150° F. and no greater than about 180° F. The contamination of the liquid heating medium by various wood extractives and unfixed preservative from the wood is controlled by one or more various means, and the wood is contacted with the liquid heating medium for a period of thirty minutes to about two hours to effect fixation of the preservative. Then, the liquid heating medium is removed from the fixation vessel and a vacuum in the range of from about 10" to about 30" Hg, preferably from about 15" to about 20" Hg for a duration of tip to about 30 minutes, preferably from about 10 minutes to about 30 minutes. This is followed by a rinsing of the treated and fixed wood in the fixation vessel with heated clean water, heated to a temperature no greater than about 200° F., and preferably no greater than about 180° F. Finally, the vacuum is released, the rinse water is removed from the vessel, and then the wood is removed from the vessel.

In the prior art Drinkard process, an unrecognized and unreported thermal expansion effect has been found to result from contacting the treated, un-fixed wood with the heated fixation solution. This thermal expansion of liquid and air in the wood results in the expulsion from the treated, un-fixed wood of some un-fixed preservative, as well as of various wood extractives. Unfixed preservative and wood extractives also enter the fixation solution through simple washing and diffusion action. These troublesome by-products are known to result in the formation of sludge within the fixation solution. This sludge is deposited upon the lumber surface during the fixation process, and results in a product which is aesthetically unappealing to the consumer due to its mottled and/or speckled appearance. If uncorrected, this deposited sludge can result in a product which does not pass the requirements for "fixation" since preservative may be removed from the wood by rainfall.

The rate of contamination of fixation medium by wood extractives and unfixed preservative chemicals, and the rate of development of sludge therefrom, is such that the process rapidly becomes unusable for a plant wherein a sustained cycle of production is necessary for economic reasons.

The present invention, surprisingly, has solved the difficulties of sludge formation by both minimizing its formation from wood extractives and unfixed preservative, as well as by removing the sludge once it has formed. By controlling the contamination of the liquid heating medium by unfixed preservative and various extractives from the wood, sludge formation is minimized; and where sludge formation does take place, the method of the present invention has provided procedures for effectively removing it. This can be accomplished by the application of one or more steps, preferably two or more steps as hereinafter described, in any combination thereof, substantially to obviate this contamination. The expression, "substantially to obviate" as used therein, is intended to mean the prevention or reduction of sludge formation and/or the removal thereof once formed, to such an extent that it is highly probable that it will meet consumer standards for product appearance, and regulatory standards for leachant contamination or for degree of fixation in the wood.

One of said steps to control such contamination, is to establish sufficient pressure in the fixation vessel which opposes movement of the unfixed preservative from the wood into the liquid heating medium. This applied pressure, although only moderate and neither measured nor controlled, acting on the treated wood before its contact with the fixation solution, results in substantial prevention of the thermal expansion effect, thus averting the expulsion of the preservative and wood extractives which form the sludge. The amount of pressure required for this result is generated in the course of canning out this process step, wherein the resistance to flow to be found in an open line which carries the aqueous liquid heating medium from the fixation vessel containing the wood to the aqueous liquid heating medium tank. As an attribute of the process step parameters, it is not necessary to regulate this pressure.

A second method for controlling the contamination of the liquid heating medium by the unfixed preservative from the wood is to dilute, or selectively remove the preservative from the liquid heating medium. This can be accomplished by removing the excess liquid heating medium and cooling this medium by heat exchange with clean water, the cooled liquid heating medium being used for preparing treatment solution, and the thus-heated clean water being reserved for the rinse step. This method has obvious advantages in the overall process since it not only minimizes the sludge formation, but also reduces the total overall energy requirements for the complete process.

A third method for controlling the contamination of the liquid heating medium by the wood extractives and unfixed preservative from the wood, i.e., the sludge, is by filtration of the aqueous liquid heating medium to remove the sludge-based particulate matter which may compromise the appearance or performance of the finished product. Such filtration may be by the use of any conventional filtering means using a variety of available materials, such that the pores thereof will trap and eliminate particulate matter in the general size range of from about 0.1 μm to about 10.0 μm, preferably from about 0.5 μ to about 5.0 μm. Examples of filtration means useful in this step of the process of the present invention are a filter press precoated with fine grade diatomaceous earth or a sand bed filter charged with suitable grade sand. In any case the filtration unit must be sized appropriately to remove solids from the system at an adequate rate, i.e., with an acceptable permeability. Many other suitable filtering means will be apparent to the artisan; and it will be understood that the filtration step is not limited to a single pass through the filtration means, or even to the use of a single filtration means. It is within the scope of the present invention to pass the aqueous liquid heating medium through the same filtration means several times, or to pass it successively through one filtration means and then through another, different, filtration means. For example, a coarse mesh filter or strainer may be employed to remove larger particles such as wood debris, dirt, or other coarse foreign matter from the fixation medium before it is passed through the filter press.

A fourth method for controlling the sludge formed by contamination of the liquid heating medium by the wood extractives and unfixed preservative from the wood, is by adding to the aqueous liquid heating medium one or more members selected from the group consisting of agents for adjusting the pH of said aqueous liquid heating medium. Whether such agent or agents are chosen to lower the pH, i.e., maintain it in the acid range of about 1.0 to about 5.0, or to raise the pH, i.e., maintain it in the basic range of about 9.0 to about 13.0, will depend largely on the type of heat-fixable preservative is being used in the overall process. Preservatives such as CCA (chromated copper arsenate), CCB (chromated copper borate), ACA (ammoniacal or amine copper arsenate) all require a pH adjusting agent which will lower the pH. Accordingly, such agents will preferably be mineral and organic acids, more preferably in an amount sufficient to reduce the pH of said aqueous liquid heating medium to from about 4.5 to about 3.5. On the other hand, there are heat-fixable preservatives which require use therewith of an agent which will raise the pH. Accordingly, such agents will be bases, preferably hydroxides of alkali metals and alkaline earth metals which will raise the pH of the aqueous liquid heating medium to from about 11.5 to about 13.0. It has been hypothesized that the reactions occurring during the formation of said sludge are pH depeqdent, since it has been found that regular dosing of the aqueous liquid heating medium with small amounts of sulfuric acid, introduced by way of the filtration discharge tank, and sufficient to reduce the pH thereof to about 3.5, will also reduce the rate of sludge formation by about 20%. Amounts sufficient to produce an even further reduction in pH will produce an even greater reduction in the rate of sludge formation. Accordingly, one or more members selected from the group consisting of mineral and organic acids, sulfuric acid, sulfonic acid, phosphoric acid phosphonic acid, hydrochloric acid, nitric acid, formic acid, acetic acid, and citric acid, and soluble salt forms thereof, may be added to the aqueous liquid heating medium in amounts sufficient to reduce the pH thereof to from about 4.5 to about 3.5. Correspondingly, one or more members selected from the group consisting of alkali bases and alkaline earth bases, e.g., sodium hydroxide, potassium hydroxide, barium hydroxide, strontium hydroxide, and calcium hydroxide, may be added to the aqueous liquid heating medium in amounts sufficient to raise the pH thereof to from about 11.5 to about 13.0.

An additional modification to the instant process involves the continuous circulation of the heated liquid heating medium in the fixation vessel during the fixation step of the process. This is conveniently and typically accomplished by using jet nozzles to facilitate the circulation of the heated liquid heating medium into and around the packs of wood being treated. However, other devices, such as circulating pumps or stirring mechanisms, can be used to accomplish this purpose as well.

A further modification to the overall process involves the addition of a hot water rinsing of the treated fixed wood, prior to removal of the earlier applied vacuum. This has the effect of removing contaminated fixation solution and troublesome deposits, if any, from the surface of the wood. Additionally, when the vacuum is withdraw, some of the clean water is drawn into the surface of the wood which predisposes the lumber to improved fixation performance.

Finally, in the overall process, the treated fixed wood is optionally, but desirably, removed from the fixation vessel and transferred to a system or device requiring a minimum of additional handling of the treated and fixed wood which retains said wood at ambient temperatures for an additional period of time to achieve further fixation before removal from weather protection. This may be accomplished by the use of one or more fixation bays, housed within the same building as the fixation vessel. The storage at ambient temperature within the same building takes advantage of the residual heat within the packs of treated fixed wood to further fixation before the product is exposed to the weather. Preferably, the storage time within the building is at least three hours, and preferably for as long as possible, and the bays are sloped so that the packs are tilted lengthwise, facilitating drainage and collection of drippage therefrom.

The result of these improvements in the process is an environmentally clean process, with minimal or no contamination of the environment by the preservative materials from the resultant product. A further illustration of the method of the present invention is set out below with references to the figures of the drawings. In order to prevent the description from becoming obscured with detail and hard to follow, only those valves which are open for a particular step of the process are mentioned below; those which are closed are not mentioned.

As is schematically represented in FIG. 1, after impregnation of wood with heat-fixable preservative, it is transported on a tram or other means to fixation vessel 3 having a pressure rated door 2 by means of which it is possible to maintain elevated or reduced pressures within vessel 3. The fixation process of the present invention is carried out within fixation vessel 3 in such a way that it is accompanied by the application of sufficient pressure substantially to obviate any thermal expansion effect of the treated wood. A preferred method for applying this pressure occurs during the period of contact between said treated wood and said aqueous liquid heating medium, and as a result of the following steps: (a) pumping aqueous liquid heating medium from fixation work tank 1, through pump means 6 and associated valve means 5 and 31, into fixation vessel 3 in order to fill said vessel and cover said treated wood therein; (b) turning off pump means 6 and turning on pump means 16 and opening associated valve means 18 and 19 so that aqueous liquid heating medium is introduced with agitation into fixation vessel 3 through an array of jet nozzles 14 fitted within fixation vessel 3 by means of which it is also circulated therein; (c) at the same time aqueous liquid heating medium is being introduced with agitation into fixation vessel 3, closing valve means 11 so that aqueous liquid heating medium cannot return to fixation work tank 1 through large vent and return line 13, while opening valve means 10 so that aqueous liquid heating medium may return to fixation work tank 1 through circulation return line 15, whereby hydraulic throughput of aqueous liquid heating medium from fixation vessel 3 is restricted, increasing flow resistance during circulation to effect hydraulic pressure from circulation pump 16; and (d) elevating fixation work tank outlet 21 above fixation vessel 3 during circulation to effect hydrostatic pressure. Heat energy transferred to said treated wood from aqueous liquid heating medium being circulated in fixation vessel 3 is optionally, but preferably replenished by steam coils 47 immersed in fixation work tank 1, and supplied with steam from boiler 49. Other heating means could also be used.

Treated wood in fixation, vessel 3 continues to be contacted with circulating, agitated aqueous heated liquid medium, delivered from fixation work tank 1 through outlet 21, valve means 18 and 19, and pump means 16 to fixation vessel 3, preheated to a temperature of about 150° F. to no more than about 200° F., preferably at least about 150° F. and no greater than about 180° F. for a period of thirty minutes to about two hours. Then, the fixation solution is removed from fixation vessel 3 and returned to fixation work tank 1 by pump means 6 and associated valve means 4 and 32; after which a vacuum in the range of about 10" to about 30" Hg, preferably about 15" to about 20" Hg, is applied for a duration of up to about 30 minutes, preferably from about 10 minutes to about 30 minutes, by pump means 8 and associated valve means 9. The treated and fixed wood is then rinsed in fixation vessel 3 with heated clean water from rinse tank 12, transported by pump means 16 and associated valve means 17 and 33, heated to a temperature similar to that of the aqueous liquid heating medium, or of about 180° F. The clean rinse water is heated by the passage of cold water from a pressurized utility main through heat exchanger 22, as described further below. It is preferred to supply rinse tank 12 supplementary heating means 23, which may be, as in the case of fixation work tank 1, steam coils. The vacuum is then removed from the fixation vessel by opening valve means 11, allowing ambient air flowing through large vent and return line 13 to equalize the pressure. The rinse water is then removed from fixation vessel 3 by pump means 6 and associated valve means 4 and 32, and transported to fixation work tank 1, freeing the thus treated and fixed wood.

After completion of the rinse stage, one of the steps of the present invention for controlling sludge formation is carried out, in accordance with which hot aqueous liquid heating medium is directed to one side of high efficiency heat exchanger 22 by pump means 24 and associated valve means while cold water from pressurized utility main 27 is directed through valve means 29 to the other side of high efficiency heat exchanger 22. Pumping means (not shown) may be substituted for a pressurized utility main. There, most of the energy in the hot aqueous liquid heating medium is transferred to the cold water from the main, and the thereby heated water is used to refill rinse water tank 12. Thereby cooled aqueous liquid heating medium is added to the treatment water supply tank (not shown) for replacing the preservative solution absorbed by the wood being treated. Residual water and aqueous liquid heating medium in fixation vessel 3 are transported back to storage in fixation work tank 1 by pump means 6 and associated valve means 4 and 32, as soon as the vacuum has been vented by opening valve means 11, as described above.

Another step of the present invention for preventing sludge formation is carried out during the process steps described above, in accordance with which the aqueous liquid heating medium is filtered continuously. This is accomplished by circulation of aqueous liquid heating medium from fixation work tank 1 through pump means 35 and associated valve means 36 to filtration means 38 where particulate sludge is filtered out and removed, to filtration discharge tank 20, from which it may be added to fixation work tank 1 as needed by pump means 26. Yet another step of the present invention for preventing sludge formation involves applying sufficient pressure substantially to obviate a thermal expansion effect of the treated wood. This is accomplished by elevating outlet 21 of fixation work tank 1 above aqueous liquid heating medium outlet 41 from fixation vessel 3 to fixation work tank 1 during circulation of aqueous liquid heating medium in order to effect hydrostatic pressure; or by restriction of hydraulic throughput of aqueous liquid heating medium through outlet 40 from fixation vessel 3 to storage tank 1 through valve means 11, to effect hydraulic pressure from circulation pump 16, or by a combination thereof.

Figure 2:
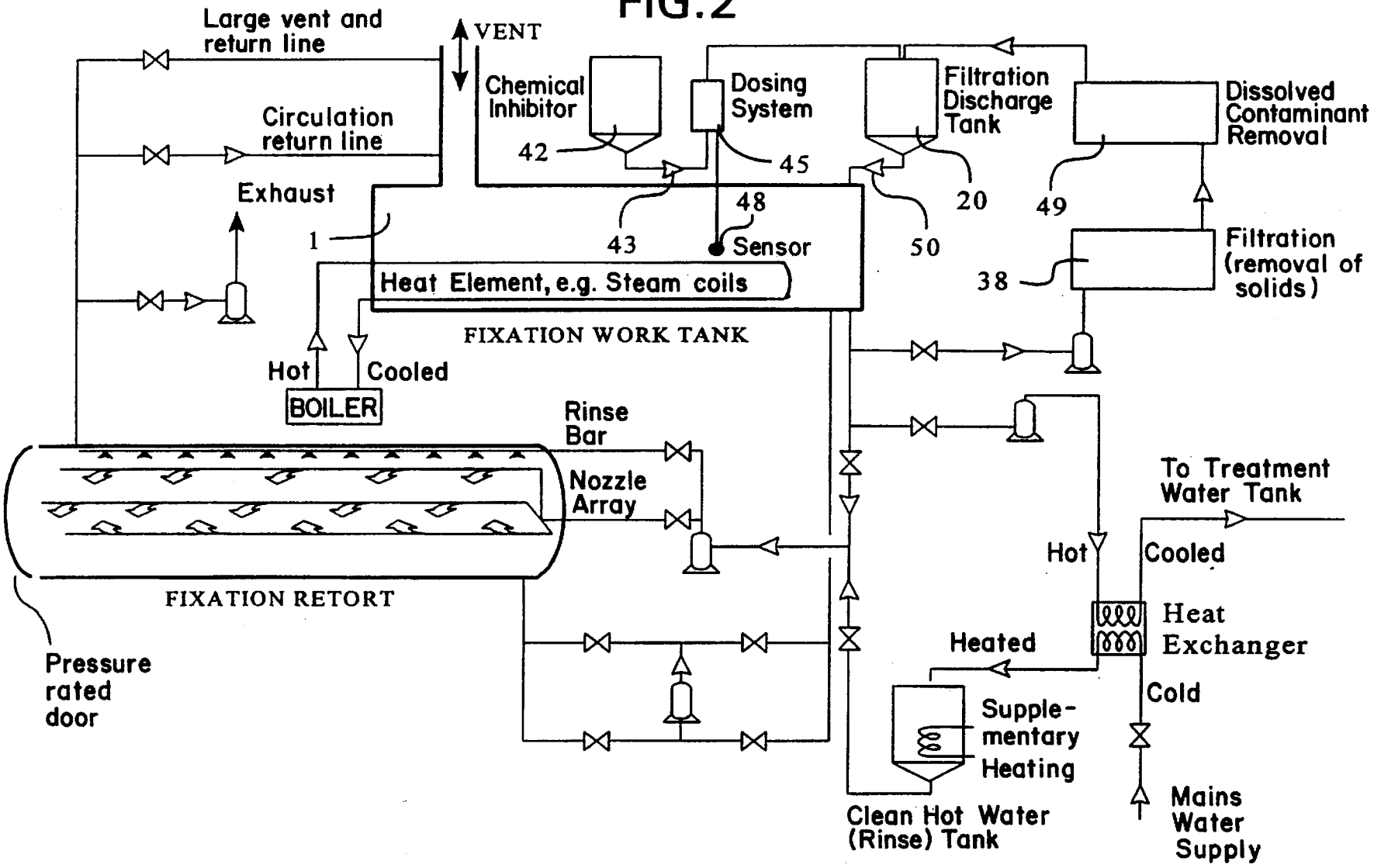
FIG. 2 is a schematic diagram of additional steps for controlling the contamination of aqueous liquid heating medium by wood extractives and unfixed preservative known to form sludge from said wood, and by said sludge, comprising the addition of chemical inhibitors to said aqueous liquid heating medium.

FIG. 2 illustrates additional aspects of the present invention relating to control of sludge formation by adding to the aqueous liquid heating medium one or more members selected from the group consisting of mineral and organic acids. These agents are kept in chemical inhibitor tank 42, from which they are dispensed through valve means 43 to a dosing system controller 45, which relies on data, e.g., pH, input from sensor 48 in fixation work tank 1 to determine when additional agent must be added. The agent is transported through controller 45 to filtration discharge tank 20, where it is added to relatively pure aqueous heating medium before being transported finally into fixation work tank 1 by pump means 26. In addition to filtration means 38 which provides for the removal of solids, there is provided dissolved contaminant removal means 49 which can remove unwanted contaminants that are dissolved in aqueous liquid heating medium passing through it. Relatively pure aqueous liquid heating medium is then transported to filtration discharge tank 20, where it is available for addition through valve means 50 and pump means 26 to fixation work tank 1 as the need arises.

Figure 3:
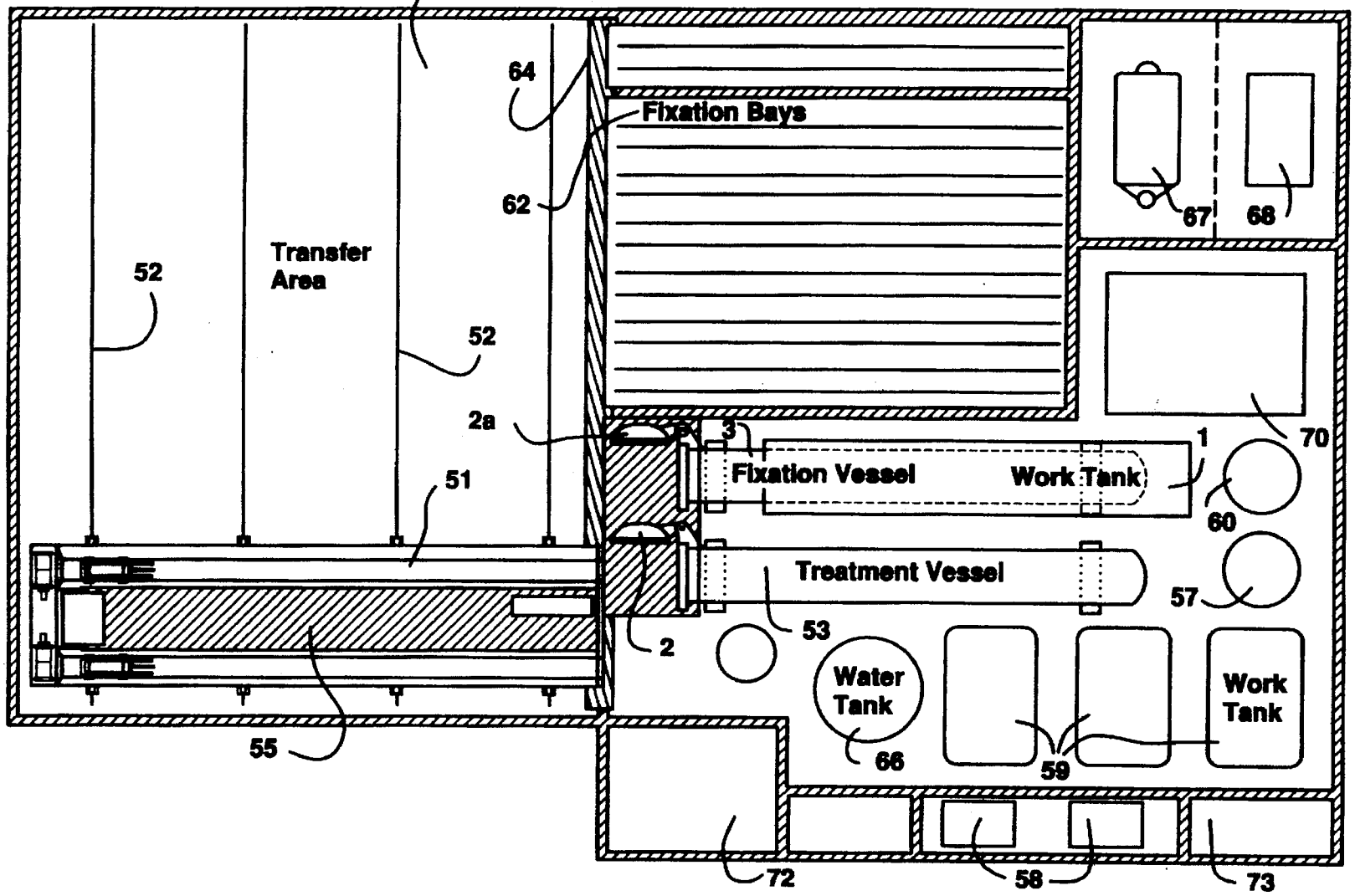
FIG. 3 is a plan view of the equipment in a typical installation for carrying out all aspects of the treatment and fixation steps of the present invention.

FIG. 3 illustrates the equipment layout and operations of a typical plant for carrying out wood treatment and fixation in accordance with the present invention. Wood to be treated is brought into the plant at point 50 where it is loaded onto transfer deck 51 which can be moved to various locations on rails 52. It has a sloped pan and hydraulic systems which permit it to manipulate the wood in the manner required at various stages. For example, transfer deck 51 first stops at treatment vessel 53 and tram 55, movably mounted on transfer deck 51, moves the wood to be treated into treatment vessel 53, after which pressure-rated door 2 is closed and sealed, allowing a vacuum to be applied to the wood inside treatment vessel 53 by means of vacuum/pressure unit 58. Heat-fixable preservative is then introduced into treatment vessel 53 from preservative supply tank 57. Pressure is applied to the wood inside treatment vessel 53 by means of a vacuum/pressure unit 58, and it is then released, after which the heat-fixable preservative is removed from treatment vessel 53 and returned to preservative supply tank 57. Preservative solutions to replace those absorbed by the wood are made up in work tanks 59. Vacuum is applied again by means of vacuum/pressure up, it 58 in order to remove excess preservative. The vacuum is then released and the wood is moved by tram 55 and transfer deck 51 out of treatment vessel 53 and into fixation vessel 3, after which pressure-rated door 2[a] is closed and sealed and fixation vessel 3 is filled with aqueous liquid heating medium from fixation work tank 1. Hot water for the aqueous liquid heating medium is supplied from hot water tank 60. After the fixation step is completed, the aqueous liquid heating medium is removed from fixation vessel 1 and returned to fixation work tank 1 and vacuum is applied. Next, the treated and fixed wood is rinsed with hot water supplied from tank 60. After the vacuum is released and the rinse water is removed from fixation vessel 3, the wood is again moved out of vessel 3 by tram 55 and transfer deck 51 to fixation bays 62 where it is stacked and held at ambient temperature. Fixation bays 62 are sloped so that the packs of stored wood are tilted lengthwise, facilitating drainage and collection of drippage therefrom in catch pan 64, from which it is returned to water tank 66.

Hot water for the various applications described above is supplied by central boiler 67, with fuel supplied from fuel supply tank 68. The equipment used in the process of the present invention to control the contamination of the aqueous liquid heating medium by wood extractives and unfixed preservative known to form sludge, as well as by the sludge itself comprising pumps, filtration means, dissolved contaminant removal means, filtration discharge tank, heat exchanger, and chemical inhibitor tank and dosing system, are located conveniently together in area 70. Utility sen, ices required for the model plant described above are supplied at 72, electrical power, and 73, pressurized utility main.

The invention is illustrated further by the following Example.

EXAMPLE

The Treatment and Fixation System

Prior to fixation, packs of unstickered, untreated wood, seasoned for treatment, are placed on a tram in the load/unload bay. Nylon straps are applied to attach the packs firmly to the tram during the entire treatment and fixation processes.

The Treatment and Impregnation Process

Tile tram is drawn into the transfer deck area and loaded into the treatment vessel. The impregnation solution applied in the treatment vessel is in accordance with earlier described solutions described in, for instance, U.S. Pat. No. 4,927,672, or other commercially acceptable solutions known in the art. Typically, the process of impregnation consists of applying a predetermined vacuum level and maintaining this vacuum while flooding the treating vessel with treating solution. Then, approximately 150 psi of pressure is applied until a target gross absorption of solution is obtained. Pressure is released, and the non-absorbed solution is transferred back to storage tank. A final vacuum is applied to remove excess solution from the wood, and the volume of solution recovered from the wood during final vacuum.

During the impregnation process, compressed air is used to move the treatment solution, rather than hydraulic pumps. Consequently, some features and abilities of the so-called hydro-pneumatic plants are unique also. For example, the "combo" tank has a number of functions, one of which is to closely control the volume of solution which is forced into the wood.

The treatment process impacts one particular aspect of the thermal fixation step. Heating freshly treated wood will cause thermal expansion of liquid and air in the wood, causing at least some preservative and wood extractives to be expelled From the wood into the fixation liquid. This contamination is undesirable, and modification of the treating process, specifically the initial vacuum to influence the degree of saturation of the wood after treatment, is one means of minimizing this contamination. Furthermore, considered application of the various steps of the treatment process as a whole will improve surface dryness of the fleshy treated wood, further reducing contamination of the fixation liquid directly by dripping, washing and diffussion action, in addition to said thermal expansion effect.

The Fixation Process

The temperature at which fixation can be successfully applied is constrained by effects on product appearance. In particular, temperatures approaching and exceeding the boiling point of water cause resin mobilization. The optimum temperature range for hot water fixation is 160° to 180° F. Temperature of the aqueous liquid heating medium is maintained at a constant level by thermostatically controlled steam coils in the aqueous liquid heating medium storage tank. Alternatively, heat input to the aqueous liquid heating medium is reduced or avoided during idle time, which acts to minimize and/or prevent at least some sludge formation.

The tram loaded with freshly treated wood is loaded into the fixation vessel by way of the transfer deck. The vessel is closed and flooded with the hot aqueous liquid heating medium, and aggressive circulation thereof is begun as soon as flooding is complete. This circulation is achieved by pumping aqueous liquid heating medium from its storage tank through an array of jet nozzles fitted within the fixation vessel. Jets of aqueous liquid heating medium from these nozzles "multiply" the flow of aqueous liquid heating medium delivered from the pump by inducing aqueous liquid heating medium present in the vessel to flow also. During this critical stage of the process the aqueous liquid heating medium forms a circuit, passing from storage tank—to pump—to nozzles—to fixation vessel, and returning to the storage tank.

Configuration of the plant is such that some pressure in the fixation vessel is generated, both from hydrostatic pressure (the storage tank is mounted above the fixation vessel) and flow resistance in the return line from the vessel to the storage tank. Thus, application of sufficient pressure to substantially obviate a thermal expansion effect of the treated wood is accomplished by (1) elevation of the aqueous liquid heating medium storage tank outlet above the fixation vessel during circulation to effect hydrostatic pressure; and (2) restricting the hydraulic throughput of the aqueous liquid heating medium from the fixation tank, so as to increase flow resistance during circulation to effect hydraulic pressure from the circulation pumps. This pressure is an attribute of the process step, and as such is neither deliberate or necessary, but will successfully oppose some of the thermal expansion effect described hereinabove.

Duration of the circulation stage is the primary means of controlling degree of fixation. Typically, the fixation is completed in about 30 minutes. The sufficiency of the fixation period is determined by performance of fixed packs of wood which are exposed to a simulated rainfall test, or other standard tests for assessing the degree of fixation for health and safety or environmental acceptability.

Aqueous liquid heating medium in the fixation vessel is then pumped back to the storage tank, and a vacuum is then applied to the hot wood. Typically, this vacuum is in excess of 18" Hg and of about 15 minutes duration. Moisture is removed from the wood by bulk flow of liquid and by evaporation.

Prior to releasing the vacuum, a predetermined amount of hot, clean water is applied to the packs of wood from a water tank specifically dedicated to the application of the rinse water. Not only does this "rinse" displace contaminated aqueous liquid heating medium and surface contamination from the packs of wood, but some of the clean rinse water will be drawn into the wood when the vacuum is released. The net effect is to predispose the final wood product to improved fixational performance.

After the rinse stage is completed, the vacuum is quickly released. At this point in the process, hot aqueous liquid heating medium from a storage tank therefor and cold water from a pressurized utility main is directed to a high efficiency heat exchanger, which transfers most of the energy in the aqueous liquid heating medium to the water from the main. The heated water from the main is used to refill the rinse water tank, while the cooled aqueous liquid heating medium is added to the water supply tank for replacing the preservative solution absorbed by the wood. This operation not only recovers energy from the transferred aqueous liquid heating medium, but minimizes the disastrous effect of elevated temperature on the CCA treatment solution. The rate of this cross-transfer is slowed to increase efficiency, but is scheduled so that the cross-transfer is completed before the next rinse cycle is necessary in the repetition of the entire process sequence.

The residual water in the fixation vessel is pumped back to storage as soon as the vacuum has been vented, to allow the door to be opened. The tram of fixed wood product is removed from the fixation vessel and transferred to one of a number of fixation bays, still housed within the same building. By taking advantage of residual heat within the packs to achieve further fixation before the product is exposed to the weather, a product having improved fixation performance is produced. The typical plant configuration has three fixation bays, which result in an additional thee hours of ongoing fixation before transfer to outdoor storage. These bays are sloped so that the packs are tilted lengthwise, thus facilitating drainage of liquid therefore.

Finally, the tram is transferred from the fixation bay to the load/unload area, where the restraining straps are untied and the product is transferred to temporary yard storage to await shipment to dealers and consumers.

During the process, the aqueous liquid heating medium is filtered continuously, during production and while the plant is idle, to remove solids which form as a result of contamination by, and interaction between wood extractives and wood preservative ingredients. If the levels of these solids, referred to herein as sludge, are not kept within limits, i.e., less than 150 ppm, they will result in a product having an unacceptable appearance.

Various modifications to this invention, in addition to those shown and described herein, will become apparent to those in the art from the foregoing description. Such modifications are intended to be within the scope of the appended claims. The references herein cited are hereby incorporated by reference.

What is claimed is:

1. A process for treating wood with heat-fixable preservatives, which comprises:

(a) placing untreated wood in a treatment vessel adapted for pressure;

(b) applying a vacuum to said wood within said treatment vessel;

(c) introducing said heat-fixable preservative into said treatment vessel in an aqueous treatment medium while substantially maintaining said vacuum;

(d) raising the pressure within said treatment vessel and impregnating said wood with said heat-fixable preservative;

(e) releasing said pressure and removing said heat-fixable preservative from said treatment vessel;

(f) applying a vacuum to remove excess preservative;

(g) releasing said vacuum, recovering said removed excess preservative to avoid spillage, and removing said treated wood from said treatment vessel;

(h) placing said treated wood in a fixation vessel;

(i) filling said fixation vessel with an aqueous liquid heating medium supplied from a fixation work tank, and preheated to a temperature of at least about 130° F. and no greater than about 200° F.;

(j) controlling contamination of said aqueous liquid heating medium (1) by wood extractives, (2) by unfixed preservative from said wood, and (3) by sludge formed from said wood extractives and said unfixed preservative within said aqueous liquid heating medium; on an intermittent and/or continuing basis at one or more points in the overall process; by employing any one or more of the following procedures, in any combination thereof:

(1') cooling aqueous liquid heating medium and rinse water from step (n) recited further below, which have been removed together from said fixation vessel, by heat exchange with clean water, thereby producing (i) cooled aqueous liquid heating medium and rinse water which are used for preparing fresh heat-fixable preservative treatment solution, and (ii) heated clean water which is reserved for rinse step (n);

(2') filtering said aqueous liquid heating medium to remove particulate sludge and other particulate matter therefrom which may compromise the appearance or performance of finished product from said method;

(3') adding to said aqueous liquid heating medium one or more members selected from the group consisting of agents for adjusting the pH of said aqueous liquid heating medium; and (4') establishing pressure in said fixation vessel which opposes movement of said wood extractives and unfixed preservative into said aqueous liquid heating medium;

(k) maintaining contact of said aqueous liquid heating medium for a period of from about thirty minutes to about two hours to effect fixation of said preservative;

(l) removing said aqueous liquid heating medium from said fixation vessel;

(m) applying a vacuum in the range of from about 10" to about 20" Hg for a duration of up to about 30 minutes;

(n) rinsing the thus treated and fixed wood in said fixation vessel with heated clean water, heated to a temperature no greater than about 200° F.; and (o) releasing said vacuum, removing said rinse water from said fixation vessel, and removing said wood from said fixation vessel.

2. A method according to claim 1 wherein said aqueous liquid heating medium is preheated to a temperature of at least about 150° F. and no greater than about 180° F.; said vacuum is in the range of from about 15" to about 20" Hg for a duration of from about 10 minutes up to about 30 minutes; and said heated clean water is heated to a temperature no greater than about 180° F.

3. A method according to claim 1, wherein said heated aqueous liquid heating medium is continuously circulated in and through said fixation vessel during fixation step (k).

4. A method according to claim 1, further comprising maintaining said treated and fixed wood in fixation bays after removal from said fixation vessel, at temperatures elevated by residual heat contained in said wood for at least three hours to achieve an increase in fixation before exposure to the weather.

5. A method according to claim 1 wherein said aqueous liquid heating medium and rinse water which have been removed together from said fixation vessel are collected in a fixation work tank, and from there are directed to a high efficiency heat exchanger so as to transfer heat from said aqueous liquid heating medium and rinse water to incoming cold water from a pressurized utility main, whereby said heat exchanger provides the primary means of heating said cold water from a pressurized utility main, which is reserved for rinse step (n).

6. A method according to claim 5 wherein said aqueous liquid heating medium and said rinse water which have been removed together from said fixation vessel, after cooling by passage through said heat exchanger, are added to a water supply tank for replacing said heat-fixable preservative treatment solution absorbed by said wood.

7. A method according to claim 1 wherein said pressure in said fixation vessel which opposes movement of said wood extractives and unfixed preservative into said aqueous liquid heating medium comprises application of sufficient pressure to substantially obviate a thermal expansion effect of said treated wood, which is accomplished by elevation of said aqueous liquid heating medium outlet from said fixation vessel to said fixation work tank to effect hydrostatic pressure, or by restriction of hydraulic throughput of said aqueous liquid heating medium outlet from said fixation vessel to said fixation work tank to effect hydraulic pressure from said circulation pumps, or by a combination thereof.

8. A method according to claim 1 wherein said aqueous liquid heating medium additionally comprises one or more members selected from the group consisting of pigments and dyes, fungicides, water repellants, flame retardants, and heat fixing resins.

9. A method according to claim 1 wherein filtration of said particulate sludge and other particulate matter from said aqueous liquid heating medium is carried out using materials such that the pores thereof will trap and eliminate said particulate sludge and other particulate matter.

10. A method according to claim 9 wherein said materials comprising a filter press precoated with fine grade diatomaceous earth or a sand bed filter charged with a grade of sand suitable for trapping and eliminating said particulate sludge and other particulate matter.

11. A method according to claim 1 wherein said aqueous liquid heating medium is passed through the same filtration material more than one time, or is passed successively through one filtration material and then through another, different, filtration material.

12. A method according to claim 1 wherein said agents for adjusting pH comprise one or more members selected from the group consisting of mineral and organic acids in an amount sufficient to reduce said pH of said aqueous liquid heating medium to from about 4.5 to about 3.5.

13. A method according to claim 12 wherein said mineral and organic acids comprise one or more members selected from the group consisting of sulfuric acid, sulfonic acid, phosphoric acid, phosphonic acid, hydrochloric acid, nitric acid, formic acid, acetic acid, and citric acid, and soluble salt forms thereof.

14. A method according to claim 1 wherein said agents for adjusting pH comprise one or more members selected from the group consisting of sodium hydroxide, potassium hydroxide, barium hydroxide, strontium hydroxide, and calcium hydroxide, which are added to said aqueous liquid heating medium in amounts sufficient to raise said pH thereof to from about 11.5 to about 13.0.

15. A process for the fixation of heat-fixable preservatives in wood which comprises:

(a) placing wood treated with said heat-fixable preservative in a fixation vessel;

(b) filling said fixation vessel with an aqueous liquid heating medium supplied from a fixation work tank, and preheated to a temperature of at least about 130° F. and no greater than about 200° F.;

(c) controlling contamination of said aqueous liquid heating medium (1) by wood extractives, (2) by unfixed preservative from said wood, and (3) by sludge formed from said wood extractives and said unfixed preservative within said aqueous liquid heating medium; on an intermittent and/or continuing basis at one or more points in the overall process, by employing any one or more of the following procedures, in any combination thereof:

(1') cooling aqueous liquid heating medium and rinse water from step (g) recited further below, which have been removed together from said fixation vessel, by heat exchange with clean water, thereby producing (i) cooled aqueous liquid heating medium and rinse water which are used for preparing fresh heat-fixable preservative treatment solution, and (ii) heated clean water which is reserved for rinse step (g);

(2') filtering said aqueous liquid heating medium to remove particulate sludge and other particulate matter therefrom which may compromise the appearance or performance of finished product from said method;

(3') adding to said aqueous liquid heating medium one or more members selected from the group consisting of agents for adjusting the pH of said aqueous liquid heating medium; and (4') establishing pressure in said fixation vessel which opposes movement of said wood extractives and unfixed preservative into said aqueous liquid heating medium;

(d) maintaining contact of said aqueous liquid heating medium for a period of from about thirty minutes to about two hours to effect fixation of said preservative;

(e) removing said aqueous liquid heating medium from said fixation vessel;

(f) applying a vacuum in the range of from about 10" to about 30" Hg for a duration of up to about 30 minutes;

(g) rinsing the thus treated and fixed wood in said fixation vessel with heated clean water, heated to a temperature no greater than about 200° F.; and (h) releasing said vacuum, removing said rinse water from said fixation vessel, and removing said wood from said fixation vessel.

16. A method according to claim 15 wherein said aqueous liquid heating medium is preheated to a temperature of at least about 150° F. and no greater than about 180° F.; said vacuum is in the range of from about 15" to about 20" Hg for a duration of from about 10 minutes up to about 30 minutes; and said heated clean water is heated to a temperature no greater than about 180° F.

17. A method according to claim 15 wherein said heated aqueous liquid heating medium is continuously circulated in said fixation vessel during fixation step (d).

18. A method according to claim 15, further comprising maintaining said treated and fixed wood in fixation bays after removal from said fixation vessel, at temperatures elevated by residual heat contained in said wood for at least three hours to achieve an increase in fixation before exposure to the weather.

19. A method according to claim 15 wherein said aqueous liquid heating medium and rinse water which have been removed together from said fixation vessel are collected in said fixation work tank and from there are directed to a high efficiency heat exchanger so as to transfer heat from said aqueous liquid heating medium and rinse water to incoming cold water from a pressurized utility main, whereby said heat exchanger provides the primary means of heating said cold water from a pressurized utility main, which is reserved for rinse step (g).

20. A method according to claim 19 wherein said aqueous liquid heating medium and said rinse water which have been removed together from said fixation vessel, after cooling by passage through said heat exchanger, are added to a water supply tank for replacing said heat-fixable preservative treatment solution absorbed by said wood.

21. A method according to claim 15 wherein said pressure in said fixation vessel which opposes movement of said wood extractives and unfixed preservative into said aqueous liquid heating medium comprises application of sufficient pressure to substantially obviate a thermal expansion effect of said treated wood, which is accomplished by elevation of said aqueous liquid heating medium outlet from said fixation vessel to said fixation work tank to effect hydrostatic pressure, or by restriction of hydraulic throughput of said aqueous liquid heating medium outlet from said fixation vessel to said fixation work tank to effect hydraulic pressure from said circulation pumps, or by a combination thereof.

22. A method according to claim 15 wherein said aqueous liquid heating medium additionally comprises one or more members selected from the group consisting of pigments and dyes, fungicides, water repellants, flame retardants, and heat fixing resins.

23. A method according to claim 15 wherein filtration of said particulate sludge and other particulate matter from said aqueous liquid heating medium is carried out using materials such that the pores thereof will trap and eliminate said particulate sludge and other particulate matter.

24. A method according to claim 23 wherein said materials comprising a filter press precoated with fine grade diatomaceous earth or a sand bed filter charged with a grade of sand suitable for trapping and eliminating said particulate sludge and other particulate matter.

25. A method according to claim 15 wherein said aqueous liquid heating medium is passed through the same filtration material more than one time, or is passed successively through one filtration material and then through another, different, filtration material.

26. A method according to claim 15 wherein said agents for adjusting pH comprise one or more members selected from the group consisting of mineral and organic acids in an amount sufficient to reduce said pH of said aqueous liquid heating medium to from about 4.5 to about 3.5.

27. A method according to claim 26 wherein said mineral and organic acids comprise one or more members selected from the group consisting of sulfuric acid, sulfonic acid, phosphoric acid, phosphonic acid, hydrochloric acid, nitric acid, formic acid, acetic acid, and citric acid, and soluble salt forms thereof.

28. A method according to claim 15 wherein said agents for adjusting pH comprise one or more members selected from the group consisting of sodium hydroxide, potassium hydroxide, barium hydroxide, strontium hydroxide, and calcium hydroxide, which are added to said aqueous liquid heating medium in amounts sufficient to raise said pH thereof to from about 11.5 to about 13.0.

* * * * *